US006719541B2

(12) United States Patent
Bundy

(10) Patent No.: US 6,719,541 B2
(45) Date of Patent: Apr. 13, 2004

(54) FAN ASSEMBLY WITH APPLICATION TO VACUUM CLEANER

(75) Inventor: Kenneth L. Bundy, Theresa, NY (US)

(73) Assignee: Northland/Scott Fetzer Company, Watertown, NY (US)

( * ) Notice: Subject to any disclaimer, the term of this patent is extended or adjusted under 35 U.S.C. 154(b) by 8 days.

(21) Appl. No.: 10/135,237

(22) Filed: Apr. 30, 2002

(65) Prior Publication Data

US 2003/0202890 A1 Oct. 30, 2003

(51) Int. Cl.[7] ..... F04B 39/06

(52) U.S. Cl. ..... 417/366

(58) Field of Search ..... 417/366, 369, 417/423.14, 428.2; 416/175, 183, 186 R, 203; 15/41.1, 300.1; 415/74, 92, 121, 143, 202, 203, 204, 206

(56) References Cited

U.S. PATENT DOCUMENTS

| | | | | | |
|---|---|---|---|---|---|
| 1,335,129 | A | | 3/1920 | Schroeder | |
| 1,652,134 | A | | 12/1927 | Thomson | |
| 1,940,260 | A | * | 12/1933 | Ljungquist | 248/16 |
| 1,996,460 | A | | 4/1935 | Coates | |
| 2,043,655 | A | | 6/1936 | Ehrmann | |
| 2,050,180 | A | | 8/1936 | Hurxthal | |
| 2,091,537 | A | * | 8/1937 | Wahlborg | 230/117 |
| 2,165,678 | A | * | 7/1939 | Riebel, Jr. et al. | 15/16 |
| 2,236,265 | A | * | 3/1941 | Hansson et al. | 230/117 |
| 2,349,215 | A | * | 5/1944 | Wahlborg | 248/26 |
| 2,494,200 | A | | 1/1950 | Ramqvist | |
| 2,494,471 | A | | 1/1950 | Claytor | |
| 2,531,342 | A | * | 11/1950 | Metz | 230/172 |
| 2,613,242 | A | * | 10/1952 | Shumaker et al. | 172/278 |
| 2,767,906 | A | * | 10/1956 | Doyle | 230/134 |
| 3,082,940 | A | * | 3/1963 | Frantz | 230/235 |
| 3,127,094 | A | | 3/1964 | Smith | |
| 3,733,150 | A | | 5/1973 | Porter et al. | |
| 4,623,811 | A | * | 11/1986 | Nystuen et al. | 310/192 |
| 4,893,995 | A | | 1/1990 | Hufstader | |
| 4,961,016 | A | | 10/1990 | Peng et al. | |
| 5,201,877 | A | * | 4/1993 | Relin et al. | 406/85 |
| 5,281,088 | A | | 1/1994 | Brandt | |
| 5,567,127 | A | * | 10/1996 | Wentz | 417/312 |
| 5,705,865 | A | | 1/1998 | Ishida et al. | |
| 5,722,110 | A | * | 3/1998 | McIntyre et al. | 15/329 |
| 5,925,960 | A | | 7/1999 | Hayes | |
| 6,012,909 | A | | 1/2000 | Sloteman et al. | |
| 6,024,543 | A | | 2/2000 | Lambertson | |
| 6,231,311 | B1 | | 5/2001 | Gatley et al. | |
| 6,309,180 | B1 | | 10/2001 | Gilliland et al. | |
| 6,481,050 | B1 | * | 11/2002 | Wilson et al. | 15/413 |
| 6,510,582 | B1 | * | 1/2003 | Yoo | 15/323 |

FOREIGN PATENT DOCUMENTS

JP 404330399 A * 11/1992

* cited by examiner

*Primary Examiner*—Justine R. Yu
*Assistant Examiner*—John F. Belena
(74) *Attorney, Agent, or Firm*—Jones Day

(57) ABSTRACT

An open frame motor is coupled to an output shaft rotatable about an axis, and has an axially front end and an axially rear end. An impeller is mounted on the shaft and rotated about the axis to drive air radially outward. A housing has an air flow inlet, an air flow outlet, and a closed inner wall surface. The inner wall surface extends from the inlet to the outlet and surrounds the motor and the impeller. The inner wall surface is located radially outward of the impeller axially from a first location forward of the impeller to a second location rearward of the front end of the motor. The inner wall surface defines a peripheral boundary of an air flow path extending alongside the impeller and the motor from the first location to a third location rearward of the motor to cool the motor.

18 Claims, 7 Drawing Sheets

FAN ASSEMBLY WITH APPLICATION TO VACUUM CLEANER

TECHNICAL FIELD

The present invention relates to a fan assembly.

BACKGROUND

A vacuum cleaner includes a fan. The fan has an impeller rotated by a motor to drive a flow of working air through the vacuum cleaner. Dirt from household surfaces is entrained in the flow of working air. The dirt is thus transported through the vacuum cleaner into a filter bag.

SUMMARY

The present invention is an apparatus comprising an open frame motor. The motor is coupled to an output shaft rotatable about an axis, and has an axially front end and an axially rear end. An impeller is mounted on the shaft and rotated about the axis by the shaft. The impeller is configured to drive air radially outward from the impeller upon rotation of the impeller. A housing has an air flow inlet, an air flow outlet, and a closed inner wall surface. The closed inner wall surface extends from the inlet to the outlet and surrounds the motor and the impeller. The inner wall surface is located radially outward of the impeller axially from a first location forward of the impeller to a second location rearward of the front end of the motor. The closed inner wall surface defines a peripheral boundary of an air flow path extending alongside the impeller and the motor from the first location to a third location rearward of the motor. The air driven radially outward from the impeller is guided by the inner wall surface to flow alongside the motor to cool the motor.

In one preferred embodiment, the second location is located rearward of the motor, the impeller is located axially forward of the motor, the inlet is located axially forward of the impeller, and the outlet is located axially rearward of the motor. The impeller has a backplate with primary vanes extending from the backplate axially away from the motor and supplementary vanes extending from the backplate axially toward the motor.

A radially extending plate is attached to the housing. The plate is located axially between the motor and the impeller with an axially extending channel located between the plate and the inner wall surface. The channel defines part of the working air flow path. The plate is configured to direct the air radially outward toward the channel. It is further configured to support the motor. The plate has a pocket for seating a bearing that supports the shaft. At least one axially extending hole in the plate enables a circulating airflow in which the air flows frontward through the hole, radially outward in front of the plate, rearward through the channel, and radially inward behind the plate.

DESCRIPTION

Figure 1:
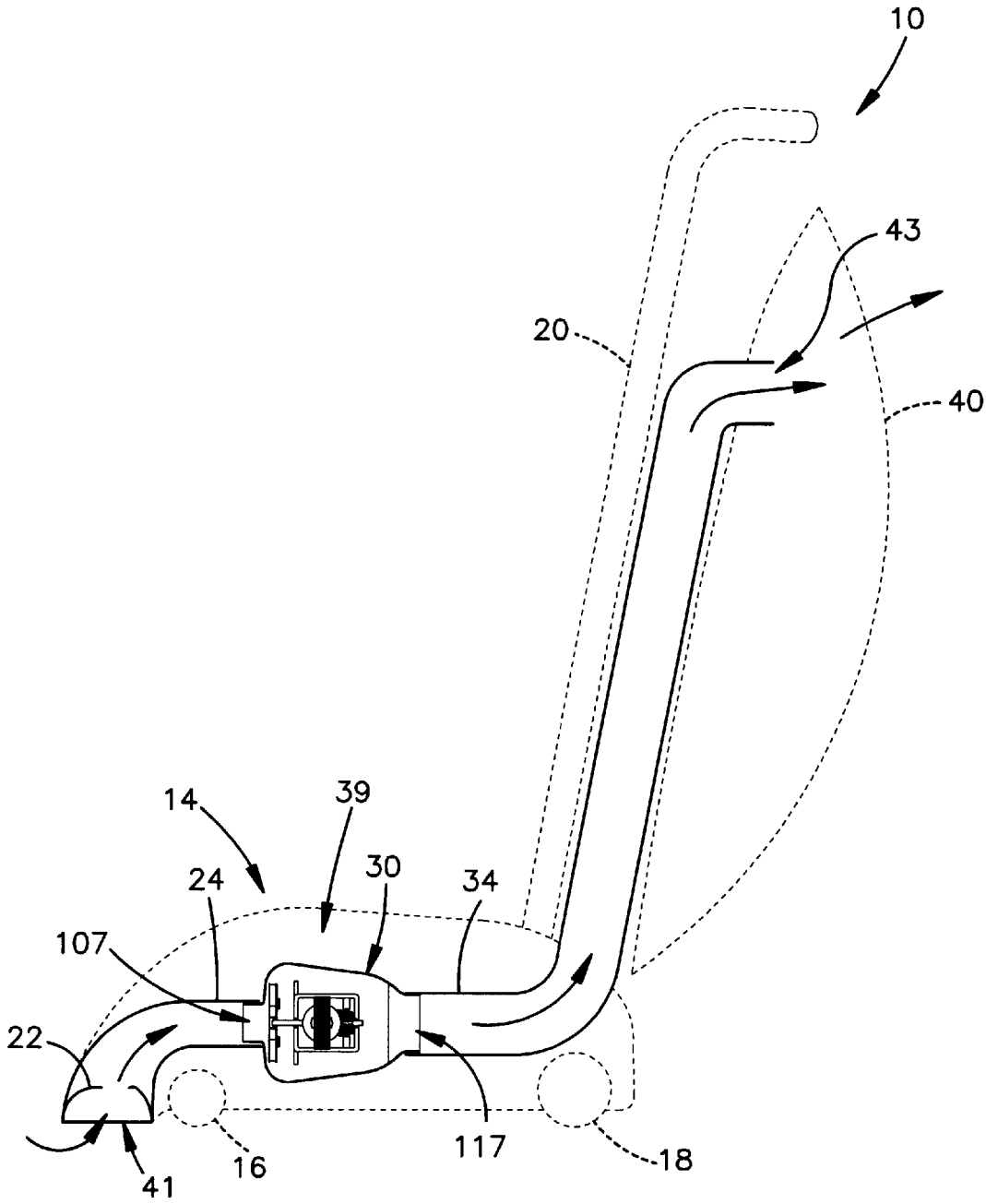
FIG. 1 is a schematic view of an apparatus comprising a first embodiment of the present invention.

The apparatus 10 shown schematically in first embodiment FIG. 1 has parts which, as described below, are examples of the elements recited in the claims.

The apparatus 10 is a vacuum cleaner. The vacuum cleaner 10 has a base 14 with wheels 16 and 18 and a handle 20. The base 14 includes a floor nozzle 22, an intake tube 24, a fan assembly 30 and an exhaust tube 34, which are interconnected to define a plenum 39. The plenum 39 extends from a plenum inlet 41 at the upstream end of the nozzle 22 to a plenum outlet 43 at the downstream end of the exhaust tube 34. A flow of working air, indicated by arrows, is generated by the fan assembly 30. Debris, such as dirt from household surfaces, is entrained in the flow of working air. The flow of working air transports the debris through the plenum 39 into a filter bag 40. The working air escapes through the bag 40 to the atmosphere, and the debris is retained in the bag 40, as is known to those of skill in the art. The air is referred to as working air, because it performs the work of moving debris by use of airflow and pressure. This vacuum cleaner 10 is commonly referred to as a "dirty air vacuum cleaner," because the air flowing through the fan assembly 30 is laden with debris.

Figure 2:
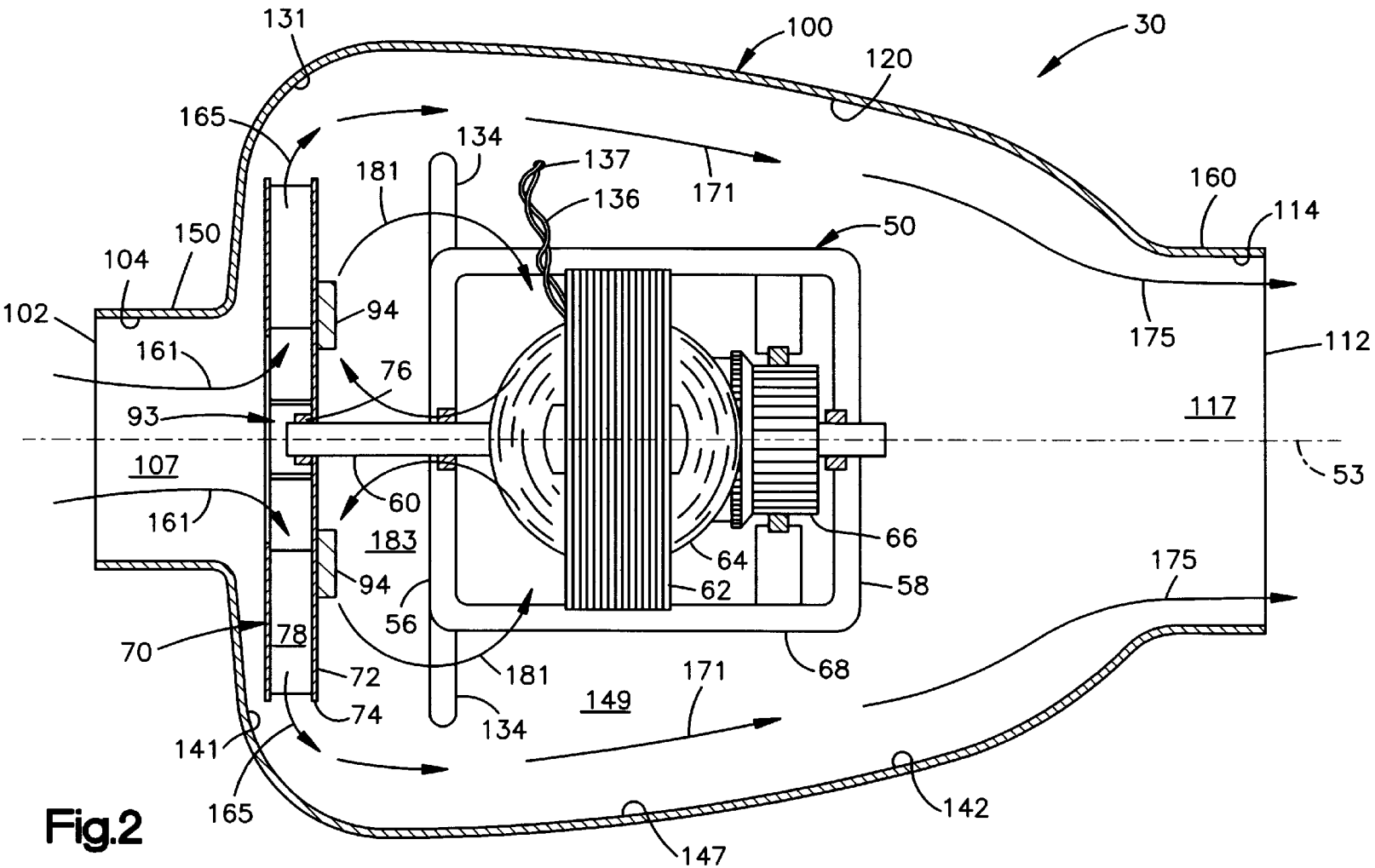
FIG. 2 is a partially sectional, partially plan, view of fan assembly parts shown in FIG. 1.

As shown in FIG. 2, the fan assembly 30 has a motor 50. The motor 50 is centered on an axis 53 and has an axially front end 56 and an axially rear end 58. The motor 50 is coupled to an output shaft 60 extending forward from the front end 56 of the motor 50. The shaft 60 is centered on, and rotates about, the axis 53. A motor is defined herein as comprising the electrical and magnetic components that interact to drive the shaft, along with the structural components, ex: a frame or casing, that hold them together. Accordingly, in this example, the motor 50 includes laminations 62, coils 64, a commutator 66 with brushes, and a motor frame 68. This motor 50 is an open frame motor. This means that the motor 50 does not include a casing enveloping the motor 50 to isolate the electrical and magnetic components 62, 64 and 66 from the working airflow and debris. Furthermore, in this example, the entire assembly 30 does not include a structure that isolates the electrical and magnetic components 62, 64 and 66 from the working air and debris. Therefore, although the frame 68 or some other structure may impede the working air and debris from contacting the electrical and magnetic components 62, 64 and 66, no structure isolates the motor components 62, 64 and 66 from the working air and debris. Although the motor 50 of this embodiment is an open frame motor, in another embodiment the motor 50 can be a closed frame motor or a motor which is isolated from the working air by another structure of the fan assembly 30.

Figure 3:
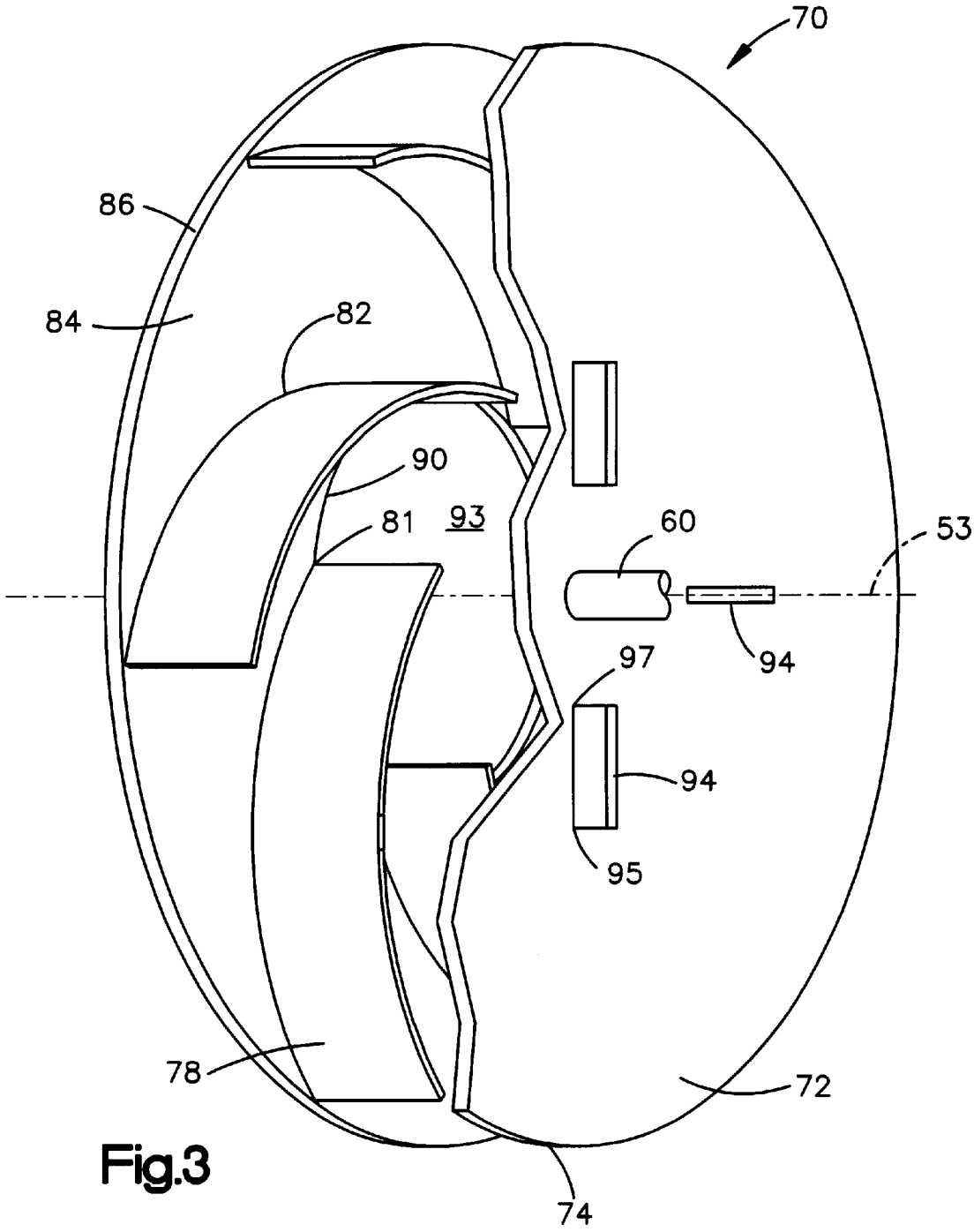
FIG. 3 is a perspective view of an impeller part shown in FIG. 2.

An impeller 70 is centered on the axis 53 axially forward of the motor 50. The impeller 70 has a circular backplate 72 with an outer edge 74. The backplate 72 is secured to the shaft 60 with a nut 76. As shown in FIG. 3, a circular array of backswept primary vanes 78 is attached to the backplate 72. Each vane 78 extends axially forward from the backplate 72, away from the motor 50. Each vane 78 also extends radially inward from the outer edge 74 of the backplate 72 to a location 81 spaced radially outward from the shaft 60.

The vanes 78 have the same size and shape and are oriented symmetrically about the axis 53. A top plate 84 is attached to the front edges 82 of the vanes 78. A circular outer edge 86 of the top plate 84 is preferably the same diameter as the outer edge 74 of the backplate 72. The top plate 84 also has an inner edge 90 defining an impeller inlet 93 centered on the axis 53. The configuration of the backplate 72, the primary vanes 78 and the top plate 84 is known in the art.

According to the present invention, the impeller 70 also includes flat supplementary vanes 94 oriented symmetrically about the axis 53. The supplementary vanes 94 extend from the backplate 72 axially rearward, toward the motor 50. Also, the supplementary vanes 94 extend directly radially inward from a first location 95 to a second location 97. The first location 95 is spaced radially inward from the outer edge 74 of the backplate 72, and the second location 97 is spaced radially outward from the shaft 60. Unlike the primary vanes 78, the supplementary vanes 94 are not capped by a top plate. Although this embodiment has four supplementary vanes 94, more or fewer vanes may also be utilized, including no vanes.

A housing 100 of the fan assembly 30 is shown in FIG. 2. The housing 100 contains the motor 50 and the impeller 70. The housing 100 has a front end 102 which, in this case, is the upstream end of the housing 100. At the front end 102, a cylindrical inlet surface 104 of the housing 100 defines an inlet 107. The inlet 107 is located axially forward of the impeller 70. The housing 100 also has a rear end 112, which, in this case, is the downstream end of the housing 100. At the rear end 112, a cylindrical outlet surface 114 of the housing 100 defines an outlet 117. The outlet 117 is located axially rearward of the motor 50.

A closed inner wall surface 120 of the housing 100 extends axially from the inlet 107 to the outlet 117. The inner wall surface 120 surrounds the motor 50 and the impeller 70 including both the primary vanes 78 and the supplementary vanes 94. In a preferred embodiment as shown in FIG. 2, the inner wall surface 120 defines a somewhat bell shape centered on the axis 53. From the inlet surface 104, the inner wall surface 120 extends radially outward, with a slight axially rearward taper, to a rounded corner 131. The corner 131 radially overlies the impeller 70. From the corner 131, the surface 120 extends axially rearward, with an increasingly radially inward taper to the outlet surface 114. The motor 50 is supported by rods 134 extending from the motor frame 68 radially outward to the housing 100. Four rods 134 are used in this embodiment, although the number of rods may vary. An electrical line 136 extends from the motor 50 to the outside via a hole 137 in the housing 100.

In the embodiment of FIG. 2, the inner wall surface 120 is located radially outward of the impeller 70 axially from a first location 141 that is forward of the impeller 70 to a second location 142 that is rearward of the front end 256 of the motor 50, and, more specifically, rearward of the motor 50. The inner wall surface 120 thus defines a peripheral boundary 147 of an airflow path 149 extending alongside the impeller 70 and the motor 50 from the first location 141 to the second location 142.

The inlet surface 104 is part of an inlet tube 150 centered on the axis 53. The inlet tube 150 may be coupled to the intake tube 24 (FIG. 1) by insertion into the intake tube 24, or by other means known to those of skill in the art. Similarly, the outlet surface 114 is part of an outlet tube 160 centered on the axis 53. The outlet tube 160 may be coupled to the exhaust tube 34 (FIG. 1) by insertion into the exhaust tube 34.

In operation, as shown in FIG. 1, the dirt laden working air flows from the plenum inlet 41 to the housing inlet 107 of the fan assembly 30. The air flows through the fan assembly 30 to the housing outlet 117. From there, it flows through the plenum outlet 43 into the filter bag 40. The working air escapes through the bag 40 to the atmosphere, and the debris that was previously entrained in the working air is retained in the bag 40.

FIG. 2 shows the path followed by the debris laden working air as it flows through the fan assembly 30. As the impeller 70 rotates about the axis 53, the air is drawn through the housing inlet 107 and the impeller inlet 93, as indicated by arrows 161. Within the impeller 70, the air is rotated by the primary vanes 78. The air is driven radially outward from the impeller 70 toward the housing surface 120, as indicated by arrows 165. Next, the air follows a spiral airflow path toward the outlet 117. The path is spiral in that the air flows circumferentially about the motor 50 as it flows axially toward the outlet 117. The axial component of the spiral airflow path is indicated by arrows 171. The air is exhausted through the housing outlet 117, as illustrated by arrows 175.

The airflow path 171 extends alongside the motor 50 and not into the motor 50. This is because the air is centrifugally forced radially outward, away from the motor 50. Drag due to the motor components 62, 64 and 66 is thus minimized. Because the debris is more dense than the air, the debris experiences a stronger radially outward force than does the air. Through cyclonic action, the debris tends to slide along the inner wall surface 120, away from the motor 50, on its way toward the housing outlet 117. This effect is desirable, because the assembly 30 has no structure that isolates the working air or the debris from contacting the motor components 62, 64 and 66.

As the working air flows alongside the motor 50, it also cools the motor 50. This is achieved by heat from the motor 50 being radiated to the working airflow 171. Additionally, heat from the motor 50 is convected to the working airflow 171 by a circulating airflow 181 of air that circulates between the working airflow 171 and the motor 50. The circulating airflow 181 is enabled by an uninterrupted open air space 183 located between the motor 50 and the impeller 70. A portion of the circulating airflow 181 extends into the open frame motor 50, thereby cooling the motor components 62, 64 and 66 through direct contact. The circulating airflow 181 tends not to entrain the debris from the working airflow 171, because the debris is centrifugally forced radially outward, away from the motor 50, as described above. The circulating airflow 181 is enhanced by the supplementary vanes 94.

Figure 4:
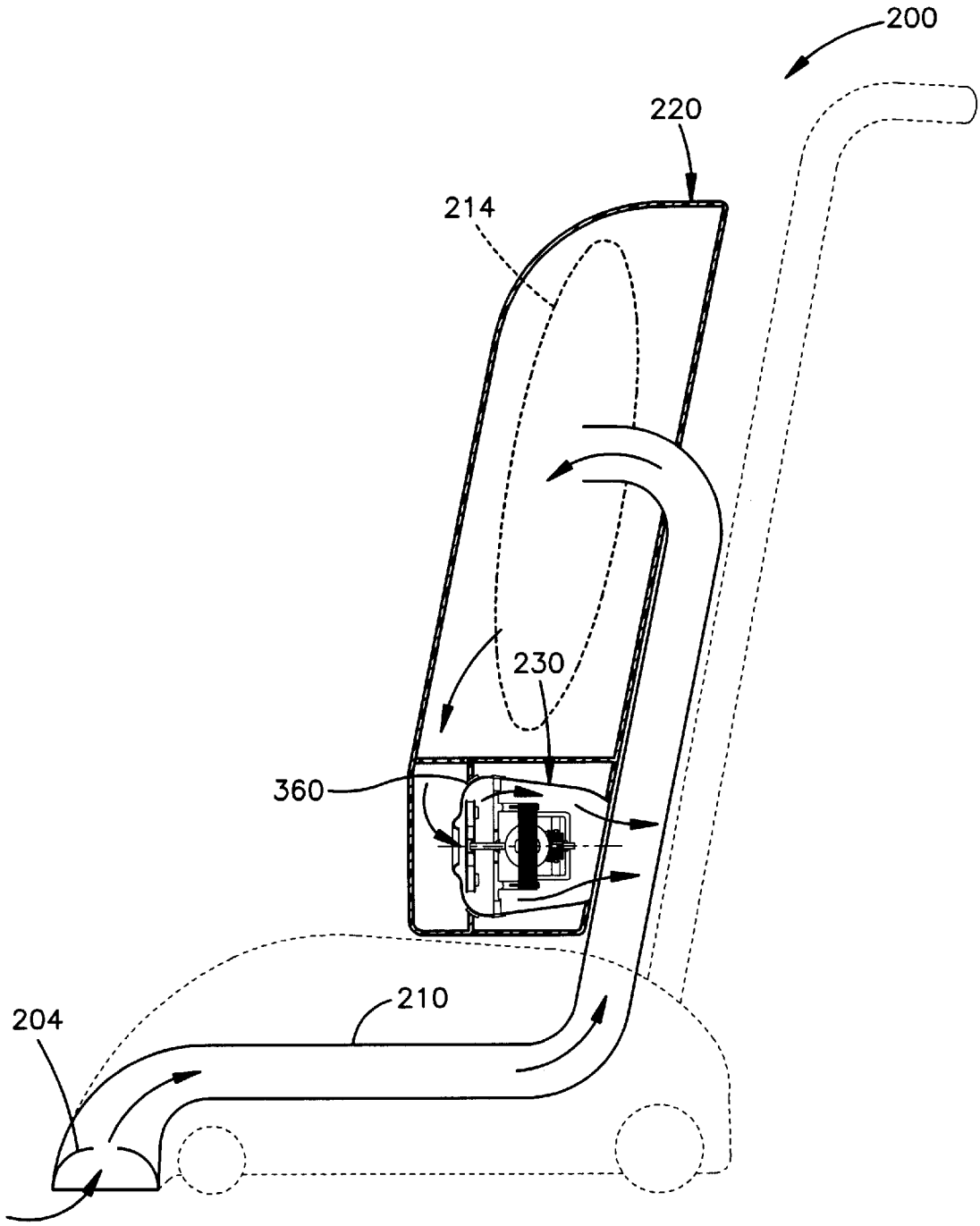
FIG. 4 is a schematic view of an apparatus comprising a second embodiment of the invention.

The vacuum cleaner described above is a dirty air vacuum cleaner. In contrast, a cleaner air vacuum cleaner 200 is illustrated schematically in second embodiment FIG. 4. As indicated by the arrows, debris laden working air passes through a nozzle 204. It continues through an air line 210 to a filter bag 214 in a vacuum chamber 220. The debris is retained in the bag 214, while the air escapes through the bag 214 into the chamber 220. The air is drawn into a fan assembly 230 and exhausted out of the chamber 220. This vacuum cleaner 200 is a "clean air vacuum cleaner" in that the debris is filtered out of the air before the air flows through the fan assembly 230.

Figure 5:
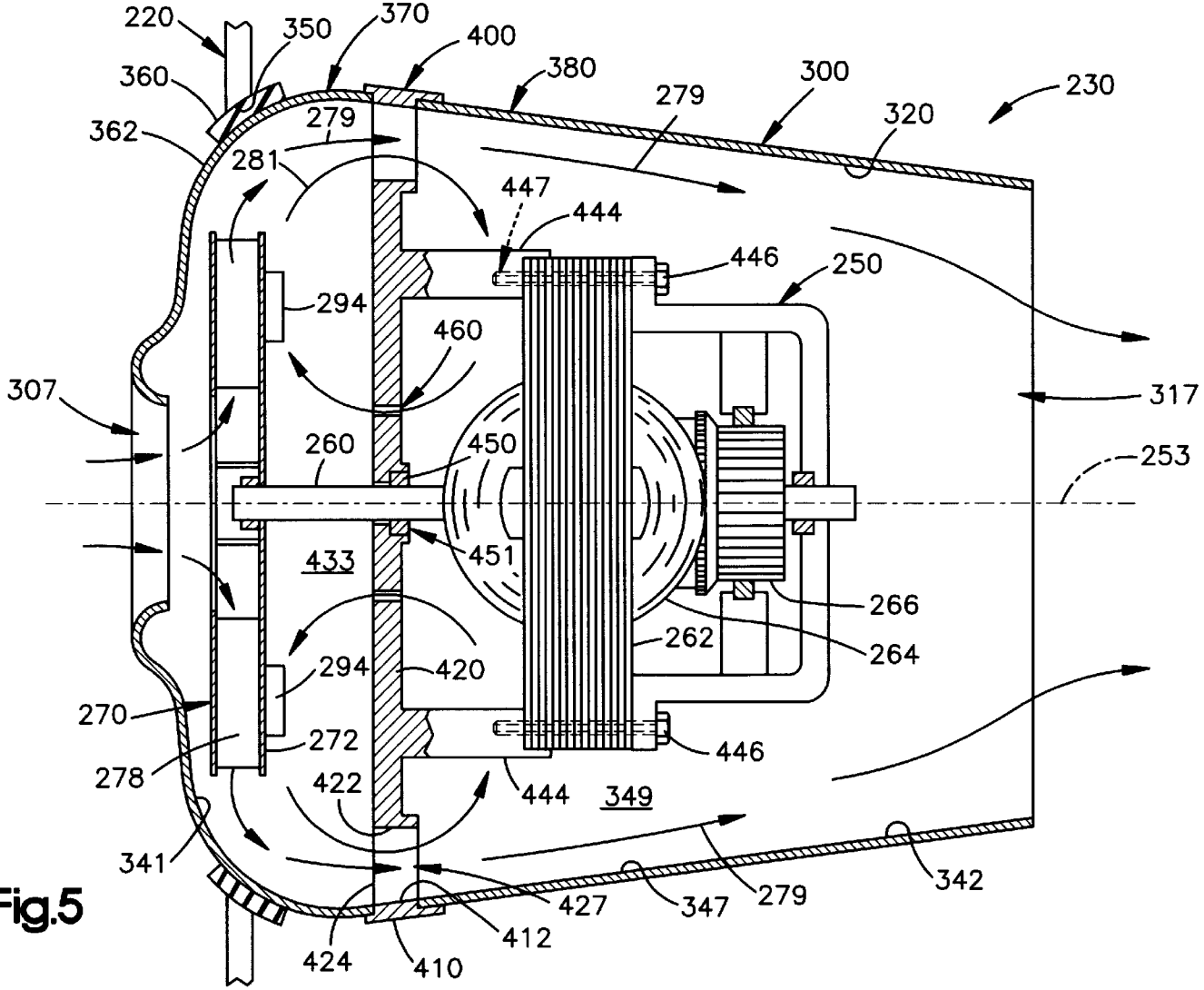
FIG. 5 is a partially sectional, partially plan, view of fan assembly parts shown in FIG. 4.

The fan assembly 230 is shown in more detail in FIG. 5. It is similar to the fan assembly 30 of FIG. 2 in the following ways. The fan assembly 230 of FIG. 5 includes a motor 250 centered on an axis 253. The motor 250 comprises laminations 262, coils 264 and a commutator 266 with brushes. An output shaft 260 extends axially through the motor 50. An impeller 270, centered on the axis 253 axially forward of the motor 250, is secured to the shaft 260. The impeller 270 has a backplate 272 from which primary vanes 278 extend forward. The primary vanes 278 produce a primary airflow 279 of working air. Supplementary vanes 294 extend from the backplate 272 rearward. They produce a circulating airflow 281 of cooling air. A housing 300 has an inlet 307 forward of the impeller 270 and an outlet 317 rearward of the motor 250. A closed inner wall surface 320 of the housing 300 extends axially from the inlet 307 to the outlet 317. The inner wall surface 320 surrounds the motor 250 and the impeller 270. The inner wall surface 320 is located radially outward of the impeller 270 axially from a first location 341 forward of the impeller 270 to a second location 342 rearward of the motor 250. It thus defines a peripheral boundary 347 of an airflow path 349 extending alongside the impeller 270 and the motor 250 from the first location 341 to the second location 342.

In this second embodiment, the fan assembly 230 is mounted against an annular outlet edge surface 350 of the vacuum chamber 220. For this purpose, an annular gasket 360 is adhered to the outer surface 362 of the housing 300. The annular gasket 360 abuts, and forms a seal against, the annular outlet edge surface 350.

The fan housing 300 comprises three interconnecting sections centered on the axis 253. Accordingly, a front section 370 surrounds the impeller 270, and a rear section 380 surrounds the motor 250. The front and rear sections 370 and 380 are connected to a middle section 400.

Figure 6:
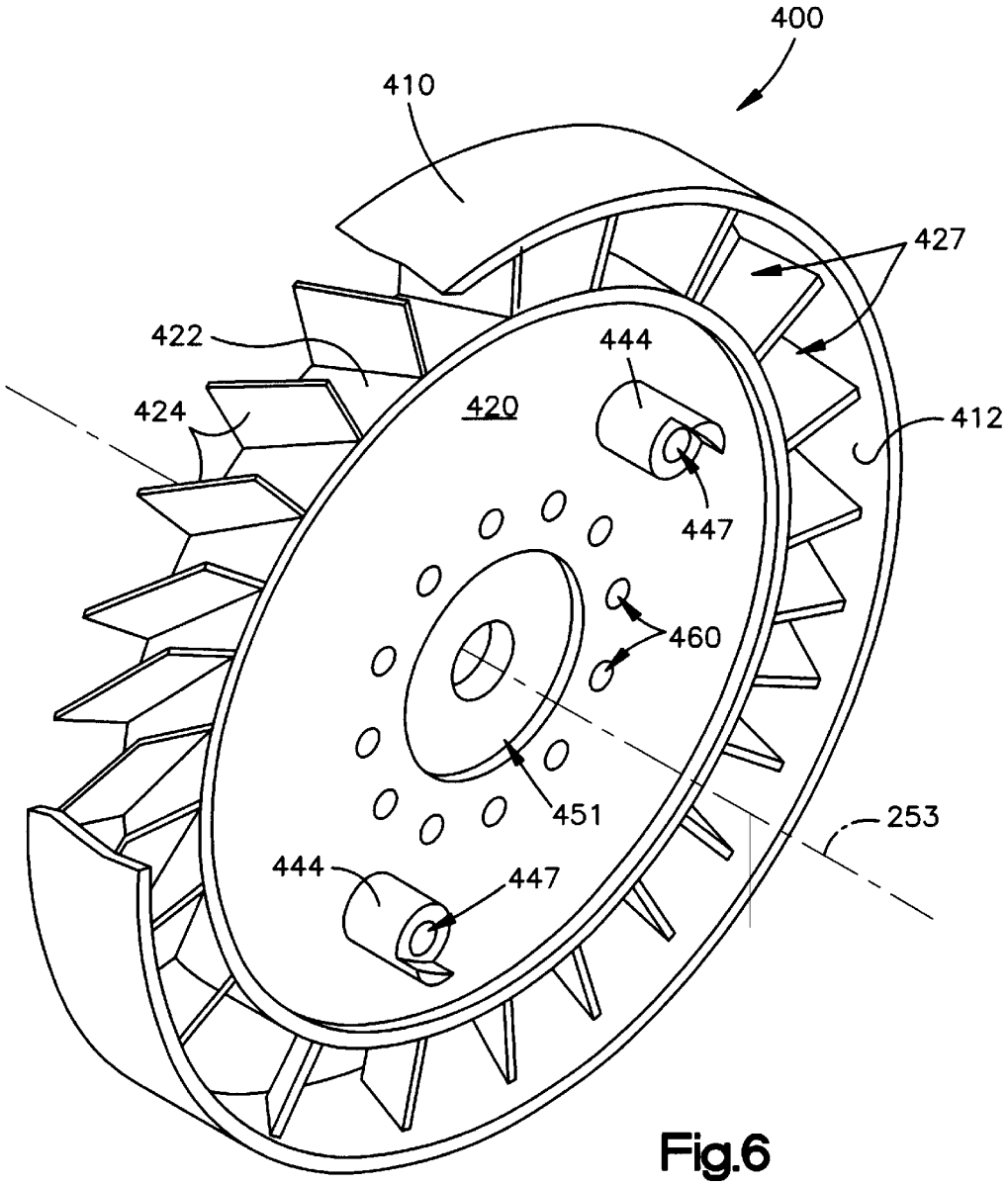
FIG. 6 is a perspective view of a mid-section part shown in FIG. 5.

As shown in FIG. 6, the middle section 400 includes a ring 410. The radially inner surface 412 of the ring 410, together with the radially inner surfaces of the front section 370 and the rear section 380 (FIG. 5), comprises the inner wall surface 320. The middle section 400 further includes a radially extending motor support plate 420. The plate 420 is centered on the axis 253 between the motor 250 and the impeller 270. A cylindrical radially outer surface 422 of the plate 420 is located radially inward from the ring 410. The radially outer surface 422 is diametrically larger than the impeller 270.

A circular array of fins 424 attaches the ring 410 to the plate 420. The fins 424 extend widthwise radially inward from the ring 410 to the plate 420. Lengthwise, the fins 424 are tilted relative to the axis 253 so as to be parallel with the working air flow path, which is spiral as described above with reference to the prior embodiment. The axial component of that air flow path is indicated by the arrows 279 in FIG. 5. An axially extending channel 427 is located between each pair of adjacent fins 424. Each channel 427 is defined by the adjacent fins 424, the radially inner surface 412 of the ring 410, and the radially outer surface 422 of the plate 420.

As shown in FIG. 5, the air space 433 between the motor 250 and the impeller 270 is interrupted by the motor support plate 420. The plate 420 directs the primary and circulating air flows 279 and 281 radially outward toward the inner wall surface 320 and the channels 427 and away from the motor 250. The plate 420 thus impedes the primary airflow from contacting the motor components. However, the assembly 230 has no structure that actually isolates the primary airflow 279 from the motor components 262, 264 and 266.

The plate 420 also supports the motor 250. For this purpose, the plate 420 has two axially extending posts 444. The motor 250 is secured to the posts 444 by fasteners 446 that extend through the motor laminations 262 and threaded holes 447 in the posts 444. By supporting the motor 250, the plate 420, together with the fins 424, serves the same function as do the rods 134 (FIG. 2) in the prior embodiment. The plate 420 also supports a bearing 450 that supports the shaft 260. The bearing 450 is seated in a pocket 451 in the plate 420.

Axially extending holes 460 in the plate 420 are arranged in a circular array centered on the axis 253. The holes 460 provide a channel for the circulating airflow 281. The path of the circulating airflow 281 is defined as follows. The circulating air 281 flows frontward through the holes 460. The circulating air 281 then flows radially outward in front of the plate 420 where the plate 420 forces the circulating airflow 281 to merge with the primary airflow 279. When merged with the primary airflow 279, the circulating airflow 281 does not entrain debris from the primary airflow 279. This is because, in the cleaner air vacuum cleaner 200 (FIG. 4) of this embodiment, the debris is filtered out of the working air before entering the fan assembly 230. Furthermore, any debris that might remain in the working air would be centrifugally forced radially outward away from the motor 250, as described above. While merged with the primary airflow 279, the circulating air 281 flows rearward through the channels 427 and thus along the inner wall surface 320. Then, behind the plate 420, the circulating air 281 flows radially inward through the motor 250 to cool the motor 250.

Figure 7:
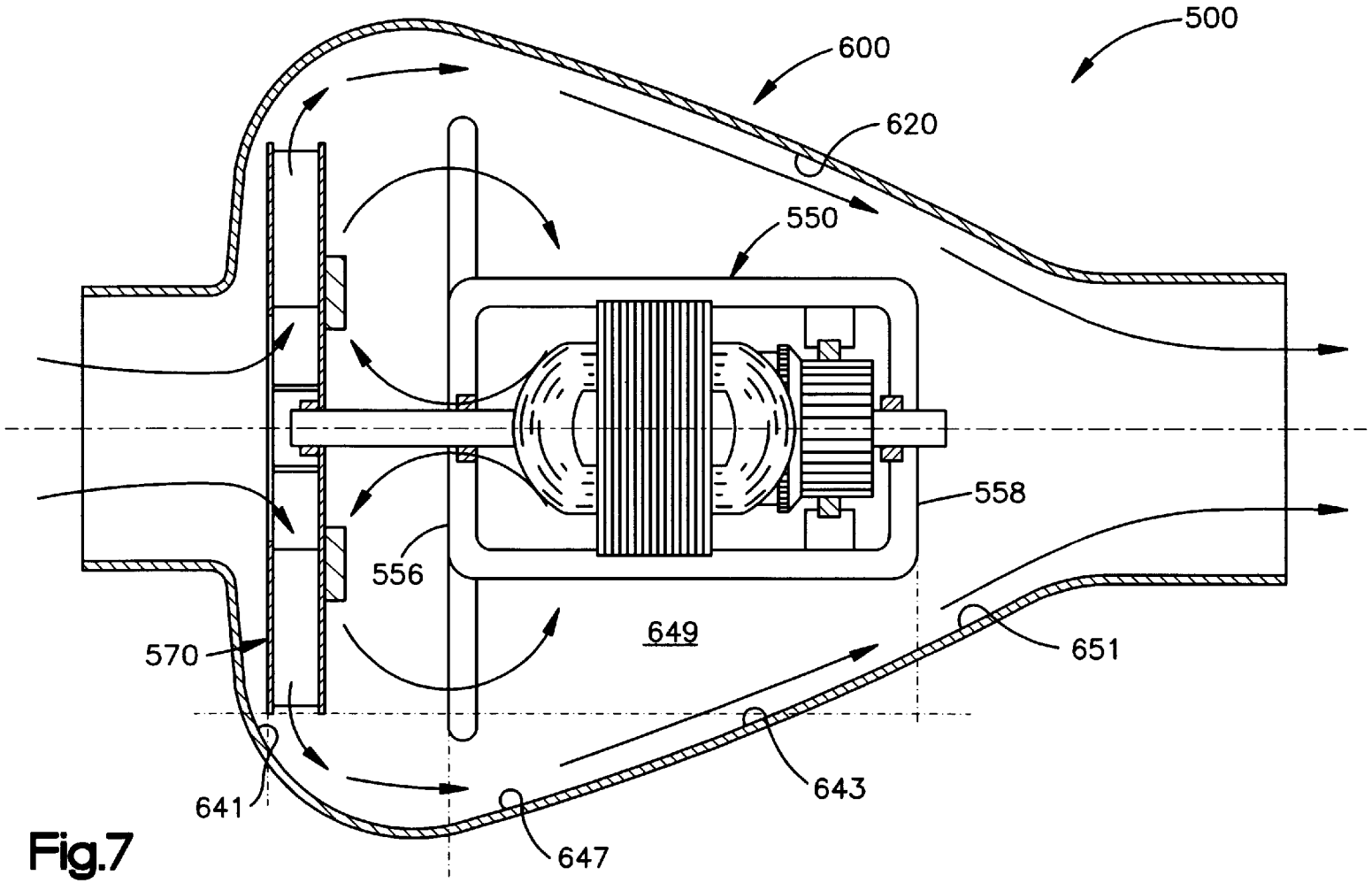
FIG. 7 is a partially sectional, partially plan, view of an apparatus comprising a third embodiment of the invention.

FIG. 7 shows a fan assembly 500 according to a third embodiment of the invention. Like the fan assembly 30 of FIG. 2, the fan assembly 500 of FIG. 7 has a motor 550 with front and rear ends 556 and 558, and an impeller 570. The motor 550 further has a housing 600 with an inner wall surface 620 that surrounds the motor 550 and the impeller 570. As in FIG. 2, the inner wall surface 620 is located radially outward of the impeller 570 axially from a first location 641 that is forward of the impeller 670 to a second location 643 that is rearward of the front end 556 of the motor 550. The inner wall surface 520 defines a peripheral boundary 647 of an airflow path 649 extending alongside the impeller 570 and the motor 550 from the first location 641 to a third location 651 that is rearward of the motor 550. Although the second location 643 is rearward of the front end 556 of the motor 550, it is not also rearward of the motor 550 as is the third location 651. This third embodiment thus differs from that of FIG. 2, in which the second and third locations can be specified by the same point 142 rearward of the motor 50. Advantageously, this design has features similar to those described with reference to FIG. 2.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus comprising:

an output shaft centered on an axis of rotation;

an open frame motor coupled to said shaft and having exposed electrical and magnetic driving components that interact to drive said shaft, said driving components having an axially front end and an axially rear end;

an impeller mounted on said shaft in front of said driving components to be rotated about said axis by said shaft, said impeller including a backplate and vanes extending forward from said backplate so as to drive air radially outward from said impeller upon rotation of said impeller; and a housing having an air flow inlet located on said axis forward of said impeller, an air flow outlet located on said axis rearward of said motor, and an inner wall surface extending from said inlet to said outlet and surrounding said motor and said impeller;

said inner wall surface being spaced radially outward from said impeller axially from a first location forward of said impeller to a second location rearward of said front end of said driving components, and further being spaced radially outward from said driving components axially from said second location to a third location rearward of said driving components;

said motor, said impeller and said housing together defining an air flow path along which the air driven by said impeller flows from said inlet to said outlet, said air flow path being open radially outward from said impeller to said inner wall surface fully along its length axially from said first location to said second location, and being open radially outward from said driving components to said inner wall surface fully along its length axially from said second location to said third location to cool said driving components.

2. The apparatus of claim 1 further comprising a plenum inlet, a plenum outlet, an intake structure connecting said plenum inlet to said housing inlet, and an exhaust structure connecting said plenum outlet to said housing outlet, thereby defining an air flow plenum that extends from said intake structure to said exhaust structure through said air flow path in said housing to conduct working air, driven by said impeller, through said plenum for said working air to move debris.

3. The apparatus of claim 2 wherein said shaft, said motor, said impeller, said housing, said plenum inlet, said plenum outlet, said intake structure and said exhaust structure are parts of a vacuum cleaner having a filter arranged to filter the debris from the working air.

4. The apparatus of claim 3 wherein said filter is located downstream from said housing such that the working air flowing along said air flow path is unfiltered dirt-laden air.

5. The apparatus of claim 3 wherein said filter is located upstream from said housing such that the working air flowing along said air flow path is filtered air.

6. The apparatus of claim 1 wherein said impeller further has supplementary vanes extending rearward from said backplate toward said driving components to enhance a circulating airflow to cool said driving components.

7. The apparatus of claim 1 further comprising a radially extending plate attached to said housing, said plate being located axially between said motor and said impeller, said plate defining an axially extending channel located entirely radially outward from said impeller and defining part of said air flow path, and said plate having an axially extending airflow aperture separate from and radially inward from said channel, whereby said channel and said aperture enable a circulating airflow in which the air flows forward through said aperture toward said impeller, then radially outward toward said channel while bounded by said plate and said impeller, then rearward through said channel, and then radially inward behind said plate toward said aperture.

8. The apparatus of claim 7 further comprising a circumferentially extending array of fins extending radially outward from said plate to said housing, and said channel is one of a plurality of channels, each of which is defined circumferentially by and between a corresponding pair of said fins and radially by and between said plate and said housing.

9. An apparatus comprising:

an output shaft centered on an axis;

a motor coupled to said shaft and having electrical and magnetic driving components that interact to drive said shaft, said driving components having an axially front end and an axially rear end;

an impeller mounted on said shaft in front of said driving components to be rotated about said axis by said shaft, said impeller including a backplate and vanes extending forward from said backplate so as to drive air radially outward from said impeller upon rotation of said impeller;

a housing having an air flow inlet located on said axis forward of said impeller, an air flow outlet located on said axis rearward of said motor, and an inner wall surface extending from said inlet to said outlet and surrounding said motor and said impeller;

a radially extending plate attached to said housing and located between said driving components and said impeller;

an axially extending airflow channel defined by said plate and located entirely radially outward of said impeller; and an axially extending airflow aperture in said plate, separate from and radially inward from said channel, whereby said channel and said aperture enable a circulating airflow in which the air flows forward through said aperture toward said impeller, then radially outward toward said channel while bounded by said plate and said impeller, then rearward through said channel, and then radially inward behind said plate toward said aperture.

10. The apparatus of claim 9 further comprising an attachment structure attached directly to both said motor and said plate and wherein said motor is attached to said housing solely through said attachment structure and said plate.

11. The apparatus of claim 9 wherein said channel is defined radially by and between said plate and said inner wall surface.

12. The apparatus of claim 11 further comprising a circumferentially extending array of fins extending radially outward from said plate to said housing, and said channel is one of a plurality of channels, each of which being defined circumferentially by and between a corresponding pair of said fins and radially by and between said plate and said housing.

13. The apparatus of claim 12 wherein said fins are tilted relative to said axis.

14. The apparatus of claim 9 wherein said channel is located entirely radially outward of said driving components.

15. The apparatus of claim 9 wherein said impeller further has supplementary vanes extending rearward from said backplate toward said driving components to enhance said circulating air flow to cool said driving components.

16. An apparatus comprising:

an output shaft centered on an axis;

a motor coupled to said shaft and having electrical and magnetic driving components that interact to drive said shaft, said driving components having an axially front end and an axially rear end;

an impeller mounted on said shaft in front of said driving components to be rotated about said axis by said shaft, said impeller including a backplate and vanes extending forward from said backplate so as to drive air radially outward from said impeller upon rotation of said impeller;

a radially extending plate located between said motor and said impeller;

a housing having an air flow inlet forward of said impeller, an air flow outlet rearward of said motor, and an inner wall surface extending from said inlet to said outlet and surrounding said motor, said impeller and said plate;

a circumferentially extending array of fins extending radially outward from said plate to said housing; and a circumferentially extending array of channels, each channel being defined circumferentially by and between a corresponding pair of said fins and being defined radially by and between said plate and said housing.

17. The apparatus of claim 16 wherein said fins are tilted relative to said axis.

18. The apparatus of claim 16 further comprising an attachment structure attached directly to both said motor and said plate, and wherein said motor is attached to said housing solely through said attachment structure and said plate.

* * * * *